US009470022B2

(12) United States Patent
Lange et al.

(10) Patent No.: US 9,470,022 B2
(45) Date of Patent: Oct. 18, 2016

(54) FIXED OUTSIDE HANDLE WITH MULTI-FUNCTIONS AND PROTECTED SWITCHES

(71) Applicant: GM GLOBAL TECHNOLOGY OPERATIONS LLC, Detroit, MI (US)

(72) Inventors: Richard J. Lange, Troy, MI (US); David T. Proefke, Troy, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 169 days.

(21) Appl. No.: 14/071,811

(22) Filed: Nov. 5, 2013

(65) Prior Publication Data

US 2015/0123409 A1 May 7, 2015

(51) Int. Cl.

| | |
|---|---|
| ***E05B 3/00*** | (2006.01) |
| ***E05B 85/10*** | (2014.01) |
| ***E05B 81/76*** | (2014.01) |

(52) U.S. Cl.

CPC ..... *E05B 85/10* (2013.01); *E05B 81/76* (2013.01); *Y10T 292/57* (2015.04)

(58) Field of Classification Search

USPC ..... 292/336.3, 347

See application file for complete search history.

(56) References Cited

U.S. PATENT DOCUMENTS

| | | | | |
|---|---|---|---|---|
| RE23,292 | E * | 11/1950 | Craig | 180/281 |
| 2010/0134307 | A1* | 6/2010 | Witte et al. | 340/665 |
| 2014/0292004 | A1* | 10/2014 | Ruse | 292/336.3 |

FOREIGN PATENT DOCUMENTS

EP 1291477 A2 3/2003

OTHER PUBLICATIONS

State Intellectual Property Office of the People's Republic of China, Office Action in Chinese Patent Application No. 201410614656.2 mailed Jun. 20, 2016.

* cited by examiner

*Primary Examiner* — Mark Williams

(74) *Attorney, Agent, or Firm* — Lorenz & Kopf, LLP

(57) ABSTRACT

Vehicles, vehicle doors, and door handle systems are provided. In one embodiment, a vehicle includes a vehicle door, a fixed door handle, and at least one pressure switch. The vehicle door has an outer door panel with an outer side facing an outside of the vehicle door and an interior side facing an interior of the vehicle door. The fixed door handle is at least partially disposed to the outside of the vehicle door. The at least one pressure switch is disposed in the interior of the vehicle door and is coupled with the fixed door handle such that an actuation force on the fixed door handle is at least partially transmitted to an actuation pressure on the at least one pressure switch. The at least one pressure switch indicates the actuation pressure for generating a vehicle command.

18 Claims, 3 Drawing Sheets

FIXED OUTSIDE HANDLE WITH MULTI-FUNCTIONS AND PROTECTED SWITCHES

TECHNICAL FIELD

The technical field generally relates to door handle systems for controlling a vehicle, and more particularly relates to fixed door handle systems for controlling a vehicle with protected pressure switches.

BACKGROUND

An automotive closure, such as a door for an automobile passenger compartment, is hinged to swing between open and closed positions and conventionally includes a door latch that is housed between inner and outer panels of the door. The door latch functions in a known manner to latch the door when it is closed and to lock the door in the closed position or to unlock and unlatch the door so that the door can be opened manually.

Power latch systems include a power system for electrically unlatching and electrically or mechanically latching a door. Such power latch systems are typically controlled by a mechanical switch translating or rotating a conventional door handle from a first position to a second position. The mechanical switch typically adds to the size and weight of the door handle. Additionally, the mechanical switch may be at least partially located outside of an outer door panel of the door. Location outside of the outer door panel exposes the mechanical switch to environmental conditions that may cause wear on the mechanical switch. While these systems are suitable for their intended purpose, the desire for improved systems is essentially constant.

Accordingly, it is desirable to provide systems and vehicles for operating a power door latch. Furthermore, other desirable features and characteristics of the present invention will become apparent from the subsequent detailed description and the appended claims, taken in conjunction with the accompanying drawings and the foregoing technical field and background.

SUMMARY

A vehicle is provided. In one embodiment, the vehicle includes a vehicle door, a fixed door handle, and at least one pressure switch. The vehicle door has an outer door panel with an outer side facing an outside of the vehicle door and an interior side facing an interior of the vehicle door. The fixed door handle is at least partially disposed to the outside of the vehicle door. The pressure switch is disposed in the interior of the vehicle door and is coupled with the fixed door handle such that an actuation force on the fixed door handle results in an actuation pressure on the pressure switch. The pressure switch indicates the actuation pressure for generating a vehicle command.

A vehicle controller of a vehicle having a door handle system is provided. In one embodiment, the vehicle controller is configured for receiving signals generated by at least one pressure switch that is coupled with a fixed handle of the door handle system, determining whether the pressure switches indicate a change in pressure on a handle of the door handle system, comparing the change in pressure with a stored pressure change associated with a vehicle command, and generating the vehicle command in response to matching the change in pressure with the stored pressure change.

A door handle system is provided. In one embodiment, the fixed door handle system includes a vehicle door, a fixed door handle, at least one pressure switch, and a controller. The vehicle door has an outer door panel with an outer side facing an outside of the vehicle door and an interior side facing an interior of the vehicle door. The fixed door handle is at least partially disposed to the outside of the vehicle door. The pressure switch is disposed in the interior of the vehicle door and is coupled with the fixed door handle such that an actuation force on the fixed door handle results in an actuation pressure on the pressure switch. The controller is in electronic communication with the pressure switch and generates a vehicle command based on the actuation pressure.

DESCRIPTION OF THE DRAWINGS

The exemplary embodiments will hereinafter be described in conjunction with the following drawing figures, wherein like numerals denote like elements, and wherein.

DETAILED DESCRIPTION

Figure 1:
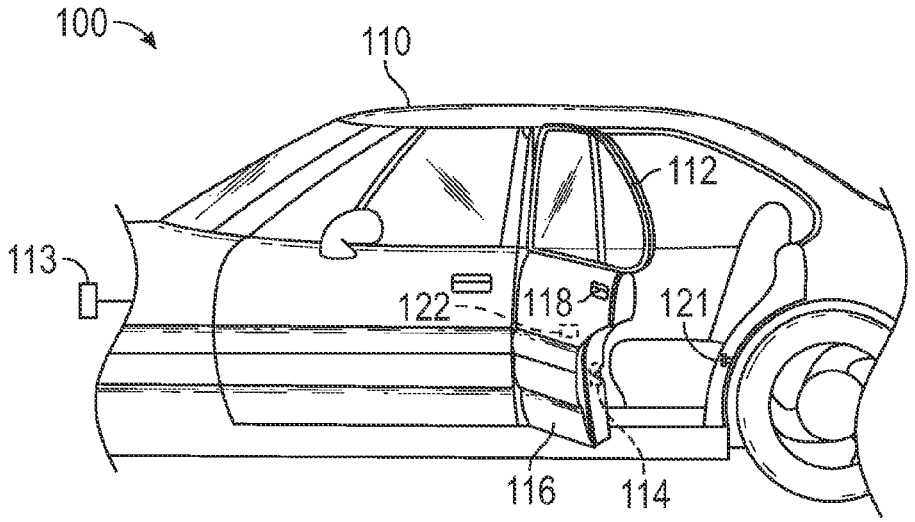
FIG. 1 is a simplified schematic diagram illustrating a vehicle in accordance with various embodiments.

The following detailed description is merely exemplary in nature and is not intended to limit the application and uses. Furthermore, there is no intention to be bound by any expressed or implied theory presented in the preceding technical field, background, brief summary or the following detailed description. It should be understood that throughout the drawings, corresponding reference numerals indicate like or corresponding parts and features. As used herein, the term controller refers to an application specific integrated circuit (ASIC), an electronic circuit, a processor (shared, dedicated, or group) and memory that executes one or more software or firmware programs, a combinational logic circuit, and/or other suitable components that provide the described functionality.

Referring now to FIG. 1, a vehicle 100 is illustrated in accordance with various embodiments. Although the figures shown herein depict example arrangements of elements, additional intervening elements, devices, features, or components may be present in an actual embodiment. It should also be understood that FIG. 1 is merely illustrative and may not be drawn to scale.

The vehicle 100 includes a vehicle body 110, a vehicle door 112, and a controller 113. The example vehicle body 110 shown is a passenger vehicle type. It should be appreciated that the vehicle may be of another vehicle type, such as a truck, an aircraft, or a watercraft without departing from the scope of the present disclosure.

The vehicle door 112 includes a door latch system 114, an outer door panel 116, and a handle assembly 118. The vehicle door 112 is illustrated as a rear side door coupled to the vehicle body 110. It should be appreciated that the present disclosure is not limited to side doors. For example, the vehicle door 112 may be a rear hatch, trunk lid, or other closeable access portion of the vehicle 100.

In various embodiments, the door latch system 114 generally includes a fork bolt (not shown), a detent lever (not shown), and an actuator 122. A striker 121 may be fixedly attached to the vehicle door 112 or the vehicle body 110 depending on the implementation of the door latch system 114. The fork bolt moves between an unlatched position and a latched position to realeasably capture the striker 121. The detent lever moves between a latched position and a released position to cause the fork bolt to move between the latched position and the unlatched position. When the detent lever is in the latched position, the fork bolt is in the latched position where the striker is captured by the fork bolt. When the striker is captured by the fork bolt, the vehicle door 110 is held closed.

When the detent lever is in the released position, the fork bolt is in the unlatched position where the fork bolt and striker 121 are released from engagement with each other. The door may be opened when the fork bolt is not engaged with the striker 121. The actuator 122 receives commands from the controller 113 to selectively position the detent lever to cause the fork bolt to latch onto and unlatch from the striker.

Figure 3:
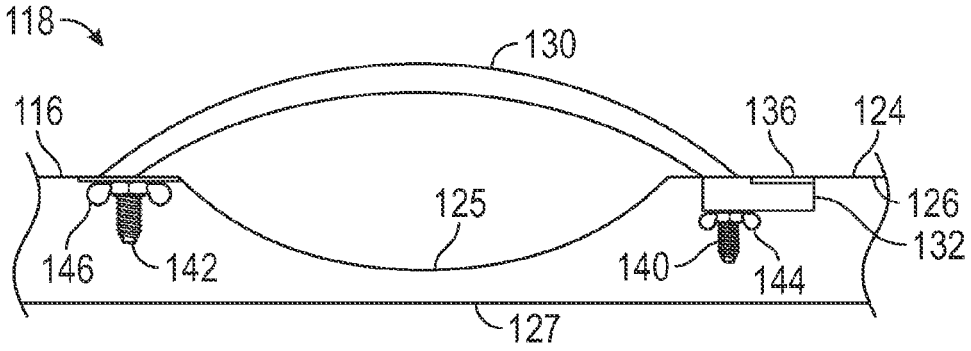

The outer door panel 116 has an outer side 124 facing an outside of the vehicle door 112 and an interior side 126 facing an interior of the vehicle door 112, as is best seen in FIG. 3. The outside of the vehicle door 112 is the external environment in which the vehicle 100 is located. Accordingly, the outer side 124 is exposed to the elements, such as rain, snow, hail, and dirt. Conversely, the interior side 126 faces the interior 124 of the vehicle door 112 that is at least partially protected from the elements by the main body of the outer door panel 116. Accordingly, the inner components (e.g., sensors or switches, as will be explained below) of the vehicle door 112 are at least partially protected from conditions that are known to cause wear and reduce the lifespan of the components. The interior 124 of the door is closed by an inner door panel 127 that faces a passenger compartment of the vehicle 100.

The outer door panel 116 further defines a finger pocket 125. The finger pocket 125 is a depression in the outer door panel 116 that accommodates fingers of a user when the user grasps the handle of the handle assembly 118. The finger pocket 125 may have any size or shape to conform with the styling and design of the vehicle 100. In some embodiments, the finger pocket 125 is a component that is separate from the outer door panel 116.

Figure 2:
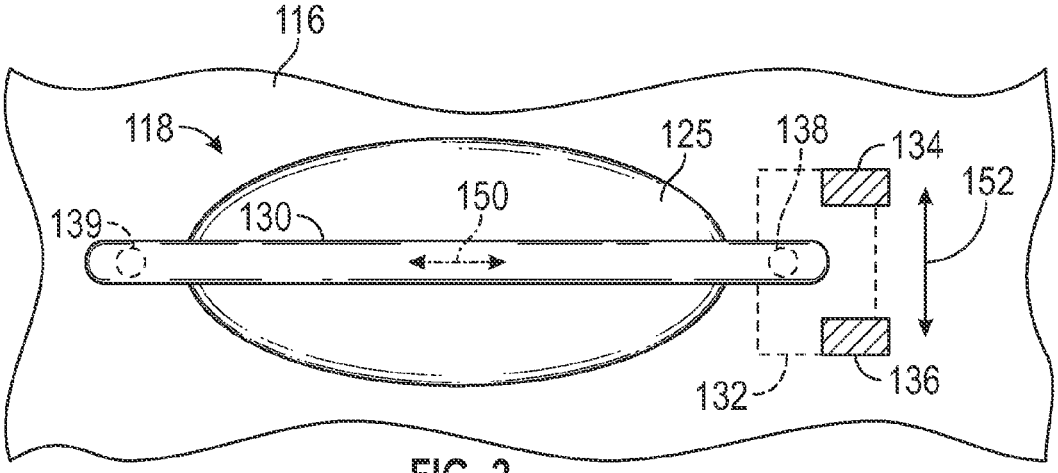
FIGS. 2-4 are schematic diagrams illustrating door handle assemblies in accordance with various embodiments.

Referring now to FIG. 2 and FIG. 3, the handle assembly 118 is illustrated in top and side views in accordance with various embodiments. The handle assembly 118 is secured to the outer door panel 116. The handle assembly 118 includes a handle 130, a stabilizer block 132, a first pressure switch 134, and a second pressure switch 136.

The handle 130 is a fixed closed end handle with opposite ends that secure to the outer door panel 116 at a first location 138 and a second location 139. As used herein, a "fixed" handle means that the handle 130 does not pivot or otherwise move between various positions other than movement due to flexing or deformation of the materials. In the example provided, the first location 138 and the second location 139 are apertures defined by the outer door panel 116. A first threaded stud 140 extends through the aperture at the first location 138 and a second threaded stud 142 extends through the aperture at the second location 139. The handle 130 is secured to the vehicle door 112 at the first location 138 with a first nut 144 that threads onto the first threaded stud 140 to clamp the outer door panel 116 and the stabilizer block 132 between the handle 130 and the first nut 144. The handle 130 is secured to the vehicle door 112 at the second location 139 with a second nut 146 that threads onto the second threaded stud 142 to clamp the outer door panel 116 between the handle 130 and the second nut 146. In some alternative embodiments, a nut is disposed in the handle 130 and a bolt extends through the outer door panel 116 to thread into the nut.

The handle 130 arches away from the outer side 124 of the outer door panel 116 in an upward direction in FIG. 3 to accommodate fingers of a user of the vehicle 100. The handle 130 spans the finger pocket 124 in a longitudinal direction 150 of the handle 130. The longitudinal direction 150 is a projection of the handle 130 onto a plane that is substantially aligned with the outer door panel 116. It should be appreciated that the handle 130 may have other shapes and sizes without departing from the scope of the present disclosure.

The stabilizer block 132 is located in the interior of the vehicle door 112 at the first location 138. The stabilizer block 132 is clamped between the first nut 144 and the inner side 126 of the outer door panel 116 to spread actuation forces applied to the handle 130 across a larger area of the inner side 126 of the outer door panel 116. The stabilizer block 132 additionally provides a convenient mounting option for the first and second pressure switches 134 and 136.

The first pressure switch 134 and the second pressure switch 136 are clamped between the stabilizer block 132 and the inner side 126 of the outer door panel 116. The first nut 144 threads on the first threaded stud 140 to provide a preloading pressure on the pressure switches 134 and 136. In some alternative embodiments, no preloading pressure is provided. The first pressure switch 134 and the second pressure switch are separated along an axis 152. The axis 152 is perpendicular to an axis that is parallel to the longitudinal direction 150 of the handle 130. The pressure switches 134 and 136 are spaced substantially equidistantly to each side of the axis that is parallel with the longitudinal direction 150. The substantially equidistant separation may be any suitable distance, or may be spaced at different distances from the axis without departing from the scope of the present disclosure. As will be appreciated by those having skill in the art, applying an actuation force to the handle 130 parallel with the axis 152 results in a pressure difference between the first pressure switch 134 and the second pressure switch 136. The difference in pressure may be used by the controller 113 to generate vehicle commands, as will be described below.

In the example provided, the pressure switches 134 and 136 are mounted on the stabilizer block 132 for simple assembly of the handle assembly 118. In some embodiments, the pressure switches 134 and 136 may be mounted on the inner side 126 or may simply be held in place by the preloading pressure of the first nut 144 rather than mounting.

The first pressure switch 134 and the second pressure switch 136 electronically indicate the clamping or actuation pressure between the stabilizer block 132 and the outer door panel 116. The indication may be a variable resistance, an actively generated signal, or any other suitable electronic indication of the actuation pressure. In the example provided, the first pressure switch 134 and the second pressure switch 136 are thin film transducer pressure sensors. The resistance change in the thin film transducer may be measured by the controller 113 or by a dedicated circuit integrated into the pressure switches.

Figure 4:
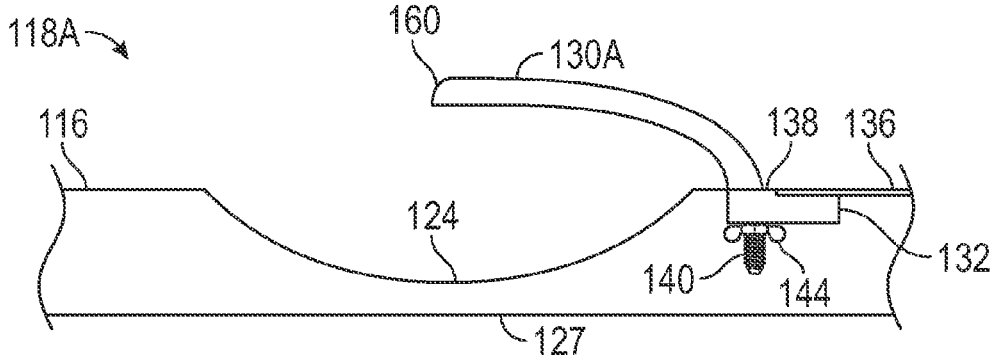

Referring now to FIG. 4, a handle assembly 118A is illustrated in a side view in accordance with various embodiments. The handle assembly 118A is similar to the handle assembly 118, where like numbers refer to like components. The handle assembly 118A, however, includes a handle 130A that secures to the outer door panel 116 only at the first location 138. The handle 130A is a cantilever style fixed handle with an open end 160. In some embodiments, the handle assembly 118A is mounted on a pillar, such as the B-Pillar of a motor vehicle, or a rear door hatch. In some embodiments, the cantilever handle 130A is be molded into an applique and the pressure pressure switches 134 and 136 are be located on fore and aft edges of the applique at the rear of the vehicle door 112.

Referring again to FIGS. 1-4, the operation of the vehicle 100 and the door handle assembly 118 will be described. An actuation force applied to the handle 130 is transmitted through the first threaded stud 140 to the first nut 144, which impacts the actuation pressure on the pressure switches 134 and 136. For example, when a user applies an outward actuation force directed away from the vehicle door 112 (e.g., upward in FIG. 3), the handle 130 transmits the force to the first threaded stud 140, which transmits the force to the first nut 144, which transmits the force to the stabilizer block 132, which presses against the inner side 126 of the outer door panel 116. Accordingly, a first pressure on the first pressure switch 134 and a second pressure on the second pressure switch 136 both increase. The varying resistances of the pressure switches 134 and 136 indicate to the controller 113 that the first and second pressures have increased (e.g., a compressive condition on the pressure switches), and the controller 113 generates a suitable vehicle command. In some embodiments, the controller 113 generates the vehicle command corresponding to a pull on the door handle when only one of the pressure switches 134 and 136 indicates a compressive condition and the other of the pressure switches 134 and 136 indicates that there is no change in pressure (e.g., neutral condition). In the example provided, the controller 113 generates a door unlatching command that commands the actuator 122 to unlatch the fork bolt of the door latch system 114 from the striker 121. It should be appreciated that the commands associated with any particular direction or magnitude of actuation force may vary based on the particular application.

An actuation force applied to the handle 130 towards the bottom of the vehicle door 112 (e.g., towards the bottom of FIG. 2) may be associated with a different vehicle command. The downward actuation force is transmitted to the stabilizer block 132—and therefore to the pressure switches 134 and 136—unevenly along the axis 152. The first pressure switch 134 indicates a compressive condition and the second pressure switch 136 indicates a decrease in the second pressure (e.g., tensile condition). Because the pressure switches 134 and 136 are subjected to a preloading pressure from the nuts 144 and 146, the actuation pressure indicated by the pressure switches indicates a deviation from the preloading pressure. In the example provided, the controller 113 generates a door unlocking vehicle command when the pressure switches 134 and 136 indicate a downward actuation force.

An actuation force applied to the handle 130 towards the top of the vehicle door 112 (e.g., towards the top of FIG. 2) may be associated with yet another vehicle command. The first pressure switch 134 indicates a tensile condition and the second pressure switch 136 indicates a compressive condition. In the example provided, the controller 113 generates a door unlocking vehicle command when the pressure switches 134 and 136 indicate an upward actuation force.

In some embodiments, an inward actuation force directed towards the interior of the vehicle (e.g., downward in FIG. 3) may be associated with yet another vehicle command. Both pressure switches 134 and 136 indicate a tensile condition when the handle 130 is subjected to the inward actuation force. In the example provided, the controller 113 generates a vehicle command to roll down the windows of the vehicle 100. In some embodiments, the controller 113 does not generate a vehicle command based on the inward actuation force.

Figure 5:
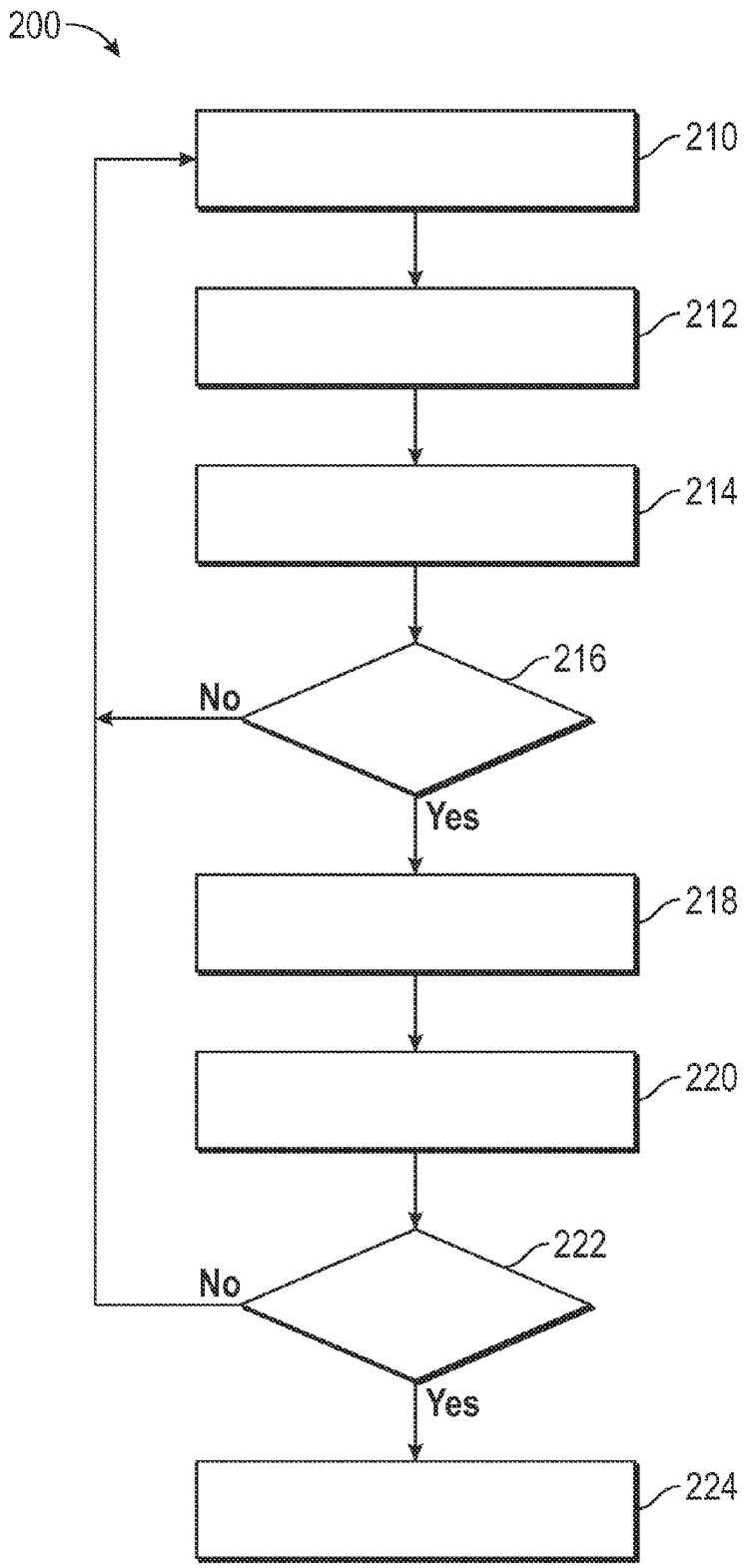
FIG. 5 is a flow diagram illustrating a method for controlling a vehicle in accordance with various embodiments.

Referring now to FIG. 5, a method 200 for controlling a vehicle is illustrated in flow diagram form. In the example provided, the operations of the method 200 are performed by the controller 113 and the vehicle 100. In operation 210, the controller 113 receives signals generated by the first and second pressure switches 134 and 136.

In operation 212, the controller 113 evaluates the received signals to determine whether the pressure switches indicate a change in pressure on the handle 130. In the example provided, the controller 113 determines whether there are rapid changes in pressure on the handle 130 over a predetermined short period of time. A short period of time, as used herein, refers to a time period that is less than approximately two seconds. A rapid pressure change as used herein refers to a pressure change over the short period of time. By evaluating rapid pressure changes over a short period of time, the effects of long term pressure decrease due to material creep may be taken into consideration. In alternative embodiments, the controller 113 may look for a change in pressure over a longer period of time. For example, the controller 113 may compare a current pressure indicated by the pressure switches with a stored pressure that indicated the pressure on the pressure switches shortly after manufacture of the vehicle or at vehicle start up.

In operation 214, the controller 113 compares the pressure changes with stored pressure changes associated with stored vehicle commands. The controller 113 determines whether the generated signal matches a vehicle command in operation 216. As described above, the vehicle commands associated with any particular user interaction with the handle 130 may include any suitable vehicle function, such as single door power unlatching, all door or single door locking, arming an alarm, all door or single door unlocking, windows and sunroof open or close, turn on or off exterior or interior lights, sound horn if the vehicle is locked and no authorized key fob is present, or any combination thereof.

For example, when a user applies an outward actuation force directed away from the vehicle door 112 (e.g., upward in FIG. 3), the controller may match a stored door unlatch operation with the generated signal from the pressure switches. In the example provided, the controller 113 is further configured to alter the stored vehicle commands based on user interaction. For example, the user may customize the vehicle commands using an infotainment system of the vehicle and based on user preferences such that the vehicle command associated with any particular force on the handle may be altered.

In operation 218, the controller 113 evaluates general requirements for generating the vehicle command. In the example provided, the general requirements are associated with security considerations. For example, the general requirements may include presence of an authorized key fob when the doors are locked. The general requirements may also be satisfied when the vehicle doors are unlocked, indicating that the vehicle 100 is not in a secure state.

In operation 220, the controller 113 evaluates command specific requirements for generating the vehicle command. For example, some vehicle commands may require presence of an authorized key fob regardless of the lock state of the vehicle 100.

In operation 222, the controller 113 determines whether to generate the vehicle command based on the general and specific requirements. When the requirements are not satisfied, the method 200 returns to operation 210 to receive further generated signals. When the requirements are satisfied, the method 200 proceeds to operation 224. In operation 224, the controller generates the vehicle command.

The embodiments described herein include several beneficial attributes. By simply pulling a fixed handle, pressure on the pressure switches may trigger unlatching a door latch. The fixed handle may further be applied to any closure with power unlatching while permitting wide flexibility in handle styling and design. Such flexibility in styling and design may permit weight savings and potentially reduce the cost of the handle assembly. Furthermore, the pressure switches may be shielded from environmental conditions that often cause reduced lifespan of such pressure switches. Moreover, the embodiments of the handle assembly described herein do not require moving parts that may be a source of failure of the handle assembly.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A vehicle comprising:

a vehicle door having an outer door panel with an outer side facing an outside of the vehicle door and an interior side facing an interior of the vehicle door;

a fixed door handle at least partially disposed to the outside of the vehicle door, wherein the fixed door handle is secured to the vehicle door in a fixed position; and at least one pressure switch coupled with the fixed door handle such that an actuation force on the fixed door handle results in an actuation pressure on the at least one pressure switch, wherein the at least one pressure switch includes a first pressure switch and a second pressure switch, and wherein the first pressure switch indicates a first pressure on the first pressure switch and the second pressure switch indicates a second pressure on the second pressure switch, and wherein the first pressure switch is separated from the second pressure switch such that a difference between the first pressure and the second pressure indicates a direction and magnitude of the actuation force, and wherein the at least one pressure switch indicates the actuation pressure for generating a vehicle command.

2. The vehicle of claim 1, further comprising a stabilizer block coupled to the fixed door handle to clamp the at least one pressure switch between the stabilizer block and the interior side of the outer door panel.

3. The vehicle of claim 2, wherein the outer door panel defines an aperture, the fixed door handle includes a stud that extends through the aperture, and the stabilizer block is secured to the stud.

4. The vehicle of claim 1, wherein the fixed door handle is a closed end handle secured with a first end secured to the outer door panel in a first location and a second end secured to the outer door panel in a second location.

5. The vehicle of claim 1, wherein the fixed door handle is a cantilever fixed handle secured to the outer door panel in a single location.

6. The vehicle of claim 1, further comprising a controller in electronic communication with the at least one pressure switch, and wherein the controller generates the vehicle command based on the actuation pressure.

7. The vehicle of claim 6, wherein the vehicle command includes at least one of operating a lock on the vehicle door and unlatching the vehicle door.

8. The vehicle of claim 6, wherein the controller is configured to customize the vehicle command based on user preferences.

9. The vehicle of claim 6, wherein the controller generates the vehicle command in response to determining that command generation requirements are satisfied.

10. The vehicle of claim 6, wherein the controller generates the vehicle command in response to a rapid pressure change indicated by the at least one pressure switch.

11. A vehicle controller of a vehicle having a door handle system, the vehicle controller configured for:

receiving signals generated by a first pressure switch and a second pressure switch that are coupled with a fixed handle of the door handle system and are separated, wherein the fixed handle is secured to a vehicle door in a fixed position and the signals indicate a first pressure on the first pressure switch and a second pressure on the second pressure switch;

determining whether the pressure switches indicate a change in pressure on a handle of the door handle system by determining a direction and a magnitude of an actuation force based on a difference between the first pressure and the second pressure;

comparing the change in pressure with a stored pressure change associated with a vehicle command; and generating the vehicle command in response to matching the change in pressure with the stored pressure change.

12. The vehicle controller of claim 11, wherein the vehicle controller is further configured to determine whether the pressure switches indicate a rapid change in pressure on the handle of the door handle system.

13. The vehicle controller of claim 11, wherein the vehicle controller is further configured to customize the vehicle command based on user interaction.

14. The vehicle controller of claim 11, wherein the vehicle controller is further configured to generate the vehicle command in response to determining that general requirements for generating the vehicle command are satisfied.

15. The vehicle controller of claim 14, wherein the vehicle controller is further configured to generate the vehicle command in response to determining that command specific requirements are satisfied.

16. A door handle system comprising:

a fixed door handle configured to be disposed to the outside of a vehicle door, wherein the fixed door handle is secured to the vehicle door in a fixed position;

at least one pressure switch coupled with the fixed door handle such that an actuation force on the fixed door handle results in an actuation pressure on the at least one pressure switch, wherein the at least one pressure switch includes a first pressure switch and a second pressure switch, and wherein the first pressure switch indicates a first pressure on the first pressure switch and the second pressure switch indicates a second pressure on the second pressure switch, and wherein the first pressure switch is separated from the second pressure switch such that a difference between the first pressure and the second pressure indicates a direction and magnitude of the actuation force; and a controller in electronic communication with the at least one pressure switch, wherein the controller generates a vehicle command based on the actuation pressure.

17. The door handle system of claim 16, further comprising a stabilizer block coupled to the fixed door handle to clamp the at least one pressure switch between the stabilizer block and an interior side of an outer door panel, wherein the fixed door handle and the stabilizer block are coupled with a preloading pressure, and wherein the actuation pressure indicated by the at least one pressure switch indicates a deviation from the preloading pressure.

18. The door handle system of claim 16, wherein the controller generates the vehicle command that includes at least one of operating a lock on the vehicle door and unlatching the vehicle door.

* * * * *